United States Patent [19]

Rowell

[11] 4,306,565

[45] Dec. 22, 1981

[54] BRASSIERE WIRE HAVING ENCAPSULATED TIPS

[76] Inventor: Ross F. Rowell, 5361 Belmore, Montreal, Quebec, Canada

[21] Appl. No.: 103,219

[22] Filed: Dec. 13, 1979

[51] Int. Cl.[3] ..... A41C 1/14

[52] U.S. Cl. ..... 128/476

[58] Field of Search ..... 128/476, 425, 465; 2/256, 257

[56] References Cited

U.S. PATENT DOCUMENTS 533,471 2/1895 Kendrick ..... 2/256

3,599,643 8/1971 Schwartz ..... 128/465

3,777,763 12/1973 Schwartz ..... 128/476

FOREIGN PATENT DOCUMENTS 2631136 7/1976 Fed. Rep. of Germany ..... 128/476

*Primary Examiner*—Doris L. Troutman

*Attorney, Agent, or Firm*—Robert J. Schaap; Eric Pincham

[57] ABSTRACT

The invention provides improvement in brassiere stays or wires wherein the ends of the stays or wires are encapsulated with tips which are securely fastened to the end of the stay or wire.

3 Claims, 10 Drawing Figures

BRASSIERE WIRE HAVING ENCAPSULATED TIPS

The invention relates to improvements in corset and brassiere stays or wires.

In the manufacture and use of stays or wires in corsets, brassieres and the like, it has been found that difficulties are encountered as to how the ends of the stays may be completed so that they will not damage the material of the garment, into which they are inserted.

In general, the stays or wires that have been used and are still being used, have always been a threat to the tearing of the garment material, and at times, cause the partial or total destruction of the garment. This is caused through the formation of the ends which provide small penetration point areas which lend themselves to the easy penetration of and through and/or the breaking of the fine texture of the material that is used in the manufacture of corsets, brassieres and similar garments.

There have been various proposals in the art for devices and methods to overcome the above problem. Thus, reference may be had to U.S. Pat. No. 2,830,300 issued April 1958; U.S. Pat. No. 2,938,215 issued May 1960; U.S. Pat. No. 3,599,643 issued August 1971, all to Schwartz; U.S. Pat. No. 3,129,435 issued April 1964 to Spence; U.S. Pat. No. 3,702,614 issued November 1972 to Miller; U.S. Pat. No. 3,126,007 issued Mar. 24, 1964 to Jonas; and U.S. Pat. No. 3,799,175 to Rowell. As will be seen from this prior art, the proposals in the art have ranged from treating the tips or ends of the wires or stays with a polymeric material so as to cap the ends to various proposals for inserting separate caps or tips on the wire ends. Each of the above proposals has, however, suffered some disadvantages. Thus, the practice of dipping or spraying or likewise depositing a "soft" material on the ends such as taught in U.S. Pat. No. 3,126,007 does, in theory, overcome many of the prior art problems. However, in practice, problems have been encountered in retaining the soft flexible tips on the wire ends—i.e. an adhesion problem has been encountered. Similarly, the use of separate flexible tip members adapted to fit on the wire ends has encountered problems in that the flexible tip members frequently separate from the wire ends. In addition, the insertion of such separate flexible tip members on the ends of the wire entails a separate step resulting in increased costs for the stay.

There are many known types of stays of various cross-sectional configurations, including square, rectangular, oval, or any configuration in cross-section between the rectangular and the round configuration, but the same objectionable features remain regarding the ends of the stays. It is therefore the purpose of this invention to provide a stay or wire that will have its ends effectively covered by an encapsulation which is interlocked in tight abutment with the end portions of the stay, so as to prevent any longitudinal or lateral movement or any dislodgement from its gripping engagement therewith.

According to the present invention, there is provided a method of encapsulating a wire or stay for a brassiere or the like comprising the steps of providing a wire, forming an aperture in one end of the wire with the aperture extending from a first side of the wire through to a further side of the wire; depositing a liquid plastic material, which plastic material is curable to a flexible solid state, on said one end; permitting the liquid plastic material to cover the one end and extend through the aperture; and curing the plastic material whereby the one end is encapsulated with a flexible plastic tip retained thereon by an integral locking pin extending from the first side to the further side through the aperture.

The invention also provides an improvement in a brassiere wire which has at least one end thereof encapsulated with a flexible tip, the improvement wherein the end has an aperture extending from a first side to a further side and the plastic tip includes an integral locking pin portion extending through the aperture to thereby securely retain the tip on the end.

Embodiments of the invention will now be described, having reference to the drawings, in which.

Figure 1:
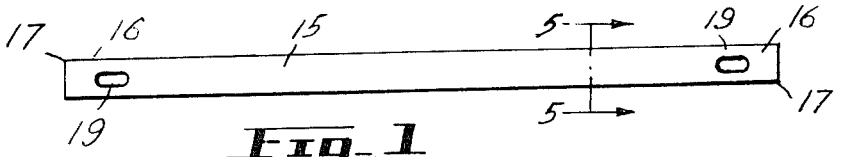
FIG. 1 is a plan view of a corset stay of a rectangular cross-sectional shape having apertures formed in and through the body of the stay and adjacent to the ends thereof.
Figure 2:
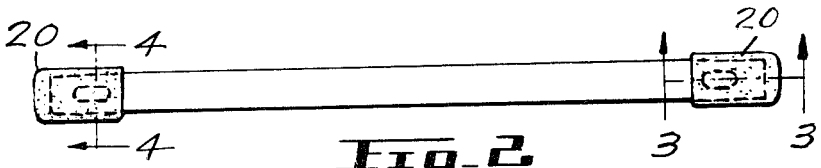
FIG. 2 is a plan view of the corset stay of FIG. 1, having its ends encapsulated.
Figure 4:
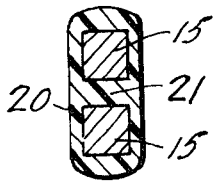
FIG. 4 is a cross-sectional view taken along the line 4—4 of FIG. 2.
Figure 5:
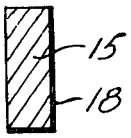
FIG. 5 is a cross-sectional view taken along the line 5—5 of FIG. 1.
Figure 3:
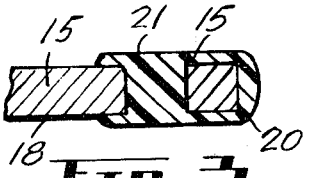
FIG. 3 is a fragmentary cross-sectional view taken along the line 3—3 of FIG. 2.
Figure 6:
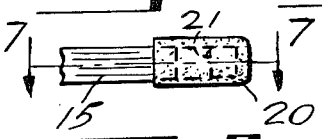
FIG. 6 is an enlarged fragmentary side view of one of the ends of the corset stay illustrated in FIG. 2.
Figure 7:
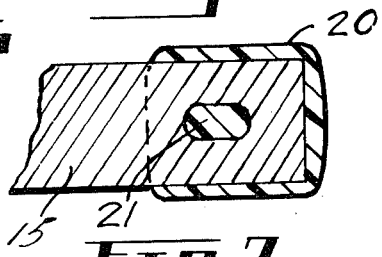
FIG. 7 is a longitudinal sectional view taken along the line 7—7 of FIG. 6.

In describing the following embodiments of encasing or encapsulating the ends of the stays or wires made in accordance with this invention, it will be noted that the wires are conventionally made of a resilient metal material and, as illustrated, are of a rectangular shape in cross-section; however, the stays may be made from other suitable materials known to those skilled in the art and may be of any desired cross-sectional configuration.

The formation of the tips or encapsulations to cover the ends of the wires and to lock the tips therewith is accomplished through the application of a flowable plastic material such as plastisols, latices; etc. The particular plastic material which is employed may be selected among many such materials known to those skilled in the art. It is essential to the practice of the invention that the plastic material be one which is flowable under certain conditions such as to encapsulate the end of the wire or stay and such that the plastic material may flow through the aperture extending from one side of the wire to a further side. The plastic material may include conventional additives such as stabilizers, fillers, pigments, etc. The plastic material is one which is curable to a solid state.

The application of the plastic material to the wires or stays may be done in many different ways such as, for example, through dipping, immersion, spraying, rolling, etc. The application of the plastic material may be accomplished at elevated temperatures, depending on the particular plastic material employed. Thus, the temperature at which the coating of the ends occurs will depend on the particular plastic material, the curing process, etc.

One particular method of encapsulating the ends of the stays is to heat-treat the stays for a predetermined period of time, immerse the heated stays or wires into a fluid plastic mix until the required coating is applied to cover the ends of the stays including the portions having apertures therethrough; and further heat-treating the coated ends and curing the plastic material.

The particular configuration of the apertures may be varied; they may be circular, rectangular, or the like. Conventionally, the cross-sectional configuration of the wires employed in brassieres are substantially rectangular and preferably, the aperture extends from one major face to the opposed major face. However, the invention is applicable to wire of any cross-sectional configuration and with an aperture likewise of any cross-sectional configuration.

In FIGS. 1 to 7, the invention is illustrated as applied to a corset stay, as indicated by numeral 15, which is preferably made from a spring-like material of a rectangular cross-sectional configuration having its ends 16 having the usual burred or ragged cutting edges or sharp corners 17 which are commonly effected in the making of stays. The faces 18 of the rectangular cross-section of the stay are flat, and locking slots 19 are formed into and through the stay body at its ends or adjacent thereto, which are preferably formed in the shape of elongated slots.

The ends 16 and the elongated slots 19 are completely enclosed by the tips or encapsulations 20 by the methods as described above, and are locked therewith by the solidifying or curing of the plastic material, forming the tips or encapsulations, within and through the elongated slots of the stay and thereby forming locking pins that are integral with the tips or encapsulations thereby securing the tips or encapsulations to the ends of the stay.

The solidified liquid fluid mix which extends through the slots or apertures 19 of the stay body now becomes locking pins 21 that are integral with the encapsulations 20. In this manner the tips or encapsulations are locked to the ends of the stay.

Figure 8:
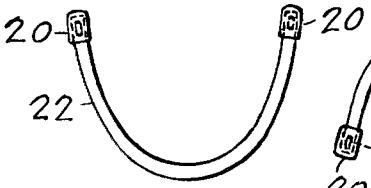
FIG. 8 is a plan view of a brassiere wire having apertures formed therein with tips or encapsulations covering the ends of the wire.

In FIG. 8, the encapsulations or tips 20 are applied to the ends of another type of wire, such as an arcuate shaped brassiere wire 22 that is formed of a rectangular cross-section. Again these encapsulations are locked with the ends of the brassiere wire through the liquid fluid mix being solidified in and through the elongated slots or apertures that are formed into and through the ends or adjacent to the ends of the brassiere wire.

Figure 9:
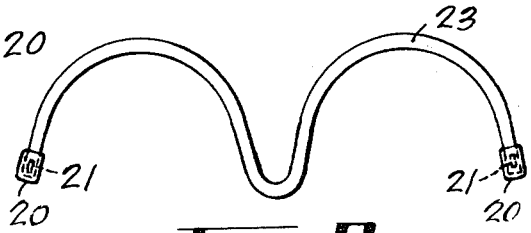
FIG. 9 is a plan view of a double breast stay or wire treated according to the present invention.

In FIG. 9, a double breast brassiere wire is illustrated showing the tips or encapsulations 20 interlocked with the ends thereof through the locking pins 21 in the manner as hereinbefore described.

Figure 10:
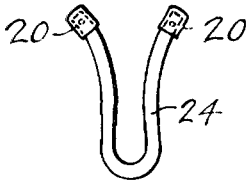
FIG. 10 is a plan view of a separator stay having apertures formed through its end portions with tips or encapsulations enclosing the ends and the apertures of the stay and interlocked therewith.

In FIG. 10, a separator wire 24 is illustrated having its ends covered by the tips or encapsulations 20 and secured thereto in a similar manner to those of the other types of stays already described. It may be noted that the apertures 19 may be circular as shown rather than elongated.

The positioning of the apertures into and through the wire body may be arranged at any desired angle, such as extending in a longitudinal direction with the side edges of the stay, extending in a transverse direction, set at a diagonal or other angle in accordance with the type of stay that is being made, the width and thickness thereof, and its shape and cross-sectional configuration.

I claim:

1. In a wire or stay suitable for use with a brassiere or like garment and wherein the wire has at least one end thereof encapsulated with a flexible plastic tip, the improvement wherein said end has an aperture extending from a first side to a further side thereof and said plastic tip includes a locking pin portion extending completely through said aperture and being integral with the plastic tip on both sides of the end to thereby securely retain the tip on said end.

2. The improvement of claim 1 wherein both ends of said wire have said plastic tips thereon.

3. The improvement of claim 1 wherein said plastic material comprises a plastisol.

* * * * *